United States Patent [19]

Sleep, Jr.

[11] Patent Number: 4,607,423

[45] Date of Patent: Aug. 26, 1986

[54] METHOD FOR MANUFACTURING A DISASSEMBLEABLE CORE HEAT EXCHANGER

[76] Inventor: Robert E. Sleep, Jr., 4304 Autumn Leaves Dr., Tampa, Fla. 33624

[21] Appl. No.: 673,680

[22] Filed: Nov. 21, 1984

Related U.S. Application Data

[63] Continuation-in-part of Ser. No. 503,619, Jun. 13, 1983.

[51] Int. Cl.[4] ..... B21D 53/02; B23P 6/00

[52] U.S. Cl. ..... 29/157.3 R; 29/401.1; 29/402.07; 29/402.08; 29/426.1; 29/157.4; 228/183

[58] Field of Search ..... 29/157.4, 157.3 R, 157.3 A, 29/157.3 B, 157.3 C, 157.3 D, 401.01, 402.01, 402.02, 402.03, 402.04, 402.05, 402.06, 402.07, 402.08, 426.1; 228/183

[56] References Cited

U.S. PATENT DOCUMENTS

| | | | |
|---|---|---|---|
| 2,389,175 | 11/1945 | Woods | 29/157.3 R |
| 4,170,055 | 10/1979 | Zethraeus | 29/157.3 R |
| 4,192,053 | 3/1980 | Blanco et al. | 29/402.08 X |
| 4,405,012 | 9/1983 | Mach | 29/157.3 R |
| 4,488,342 | 12/1984 | Daugirda | 29/157.3 R |
| 4,490,896 | 1/1985 | Small | 29/402.06 X |

*Primary Examiner*—Howard N. Goldberg
*Assistant Examiner*—Ronald S. Wallace

[57] ABSTRACT

A method of making the heat exchanger is also disclosed which includes a ring which is slipped over the periphery of the second tube retaining plate and brazed thereto and a gasket which is slipped over the tube core to form a seal between the first end portion and the elongated housing. An O-ring is slipped over the ring after the replacement of the core tubes within the housing. The O-ring seal forms a seal between the ring and the housing when the two end portions are moved towards each other by adjustable tie rods. An alternative embodiment of the invention includes an annular ledge defined by a ring or seal seat encircling the tube retaining plate and an annular shoulder extending between a bore and a counterbore of the elongated housing. The ledge and the shoulder are coplanar such that an O-ring pressed against a washer seated against the ledge and shoulder seals the annular groove between the tube retaining plate and the housing. A method for converting a flangeless-type heat exchanger into a disassembleable core heat exchanger is disclosed, also.

16 Claims, 36 Drawing Figures

METHOD FOR MANUFACTURING A DISASSEMBLEABLE CORE HEAT EXCHANGER

CROSS-REFERENCE TO RELATED PATENT APPLICATIONS

This application is a continuation-in-part of U.S. patent application, Ser. No. 503,619, filed June 13, 1983. All subject matter set forth in application Ser. No. 503,619 is hereby incorporated by reference.

BACKGROUND OF THE INVENTION

1. Field of the Invention

This invention relates to disassembleable core heat exchangers. More specifically, the invention relates to disassembleable core heat exchangers for construction machinery, vehicles, trucks or the like.

2. Information Disclosure Statement

The standard procedure recommended in carrying out repairs on the engines, transmissions, and hydraulic systems of earth moving equipment is to replace the oil cooler heat exchanger. The replacement of these heat exchangers ensures that no contaminants find their way into the relatively complex and expensive mechanisms. However, the average cost of a replacement heat exchanger is currently in the region of $900.00. This high cost of replacement greatly increases the overall cost of repairing or overhauling the transmission on tractors and other excavating equipment.

In an article in the periodical *Caterpillar Engine News* dated July 8, 1976 under the caption "Install New Oil Coolers After a Component Failure", reference is made to the needed replacement as follows: "The engine, transmission and hydraulic systems are equipped with oil coolers. Many times a failure in these systems can put debris into the lubrication or hydraulic oil. This debris is then sent to and held by the oil coolers at their specific locations. No method is known to clean or flush this debris from the oil coolers. If a new oil cooler or core is not installed when repairs are made, it is possible for the debris to work loose and get into the lubricational hydraulic system. Debris held in the oil cooler may decrease oil flow and increase oil temperature and cause other failure.

"Inspection of the damaged parts, oil pump, filters, suction screens and sumps will give a good indication of the amount of debris in the oil system. If indications show a large amount of debris, then a new oil cooler or core should be installed according to replacement specifications. It is not necessary to install a new oil cooler or core at every failure, but it is a must when inspection shows large amounts of debris in the oil system.

"The service life of a rebuilt engine, transmission or hydraulic system can be extended if a new oil cooler or core is installed when the rebuilt component is installed. If a new oil cooler or core is installed at the time of rebuilding, then debris from the previous failure cannot re-enter the lubrication system."

The present invention has as its primary objective the overcoming of this expensive replacement of heat exchangers for engines, transmissions and other hydraulic systems.

The disassembleable core heat exchanger of the present invention overcomes the aforementioned inadequacies of the prior art devices by providing a core that can be readily removed from the heat exchanger housing for cleaning and removal of debris therefrom and which is able to be reassembled without need of expensive replacement thereof.

Another object of the invention is the provision of a heat exchanger having an elongated housing and two cooperating end portions disposed at opposite ends of the housing and a removable core of tubes slidably disposed within the housing.

Another object of the invention is the provision of a pair of collars, each collar associated with a respective end portion, the collars being adjustably moveable relative each other to seal the core tubes relative the elongated housing.

Another object of the present invention is the provision of a plurality of threaded tie rod ends disposed between the collars for adjusting the relative disposition of the collars and associated end portions.

A further objective of the present invention is to provide a method of making a disassembleable heat exchanger which includes the steps of cutting through one end of the housing in the vicinity of the second tube retaining plate and cutting said second tube retaining plate circumferentially to separate the same from the housing, cutting transversely through the other end of the housing to permit one end portion and attached core tubes to be slid out of the housing, providing a ring around the periphery of the second tube retaining plate and replacing the core tubes within the housing.

Another object of the present invention is the provision of a method of making a disassembleable heat exchanger in which a gasket or seal is disposed between the end portion and the housing and a seal is provided around the ring to form a seal between the ring and the housing.

A further object of the present invention is the provision of a heat exchanger in which, in addition to the provision of a brazed ring disposed around the second tube retaining plate, the opposite end of the housing is transversely cut in the vicinity of the first tube retaining plate. The first tube retaining plate is then cut circumferentially to enable separation of the first tube retaining plate and the core tubes from the housing. A brass or copper flange having a central aperture corresponding with the diameter of the cut first tube retaining plate is slipped over the first tube retaining plate and brazed thereto. A gasket or seal is slipped over the core tubes and positioned to form a seal between the brass or copper flange and the housing on reassembly of the core tubes with the housing.

Another object of the present invention is the provision of a removable core cooler, the configuration of which makes possible the repair of the same.

Another object of the present invention is the provision of a method of repairing the effects of fretting corrosion partially due to vibration between the core tubes and supporting baffles.

Another object of the present invention is the provision of a replaceable core configuration which facilitates the replacement of a leaking core tube.

Another object of the present invention is the provision of a disassembleable core heat exchanger in which an O-ring is pressed into sealing engagement with an annular groove defined respectively by a counterbore, an annular shoulder, an annular ledge and a tube retaining plate for sealing the groove between the housing and the retaining plate.

Another object of the present invention is the provision of a method of converting a flangeless heat exchanger into a disassembleable core tube heat exchanger.

Another object of the present invention is the provision of a disassembleable core heat exchanger in which the O-ring is pressed into sealing engagement with the annular groove by means of a core retainer which is externally threaded to cooperate with an internal thread formed on the counterbore.

Another object of the present invention is the provision of a brass ring which encircles the tube retaining plate, the space between the tube retaining plate and the brass ring being filled with lead and the annular ledge being formed in the ring and solidified lead by cutting away an annular portion of the tube retaining plate, the solidified lead and the ring.

Another object of the present invention is the provision of a ledge and a shoulder, both of which are annular in configuration and which are coplanar.

The foregoing has outlined some of the more pertinent objects of the present invention. These objects should be construed to be merely illustrative of some of the more pertinent features and applications of the invention. Many other beneficial results can be attained by applying the disclosed invention in a different manner or modifying the invention within the scope of the disclosure. Particularly, with regard to the use of the invention described herein, this should not be construed to be limited to heat exchangers for oil coolers but should include heat exchangers for all engines, transmissions, hydraulic systems and the like.

SUMMARY OF THE INVENTION

The heat exchanger of the present invention is defined by the appended claims with specific embodiments shown in the attached drawings. For the purpose of summarizing the invention, the invention relates to heat exchangers for oil coolers, for engines, transmissions and hydraulic systems or the like. The disassembleable core heat exchanger includes an elongated housing having a first passageway defined thereby. The first passageway extends along the length of the housing between a first and a second end thereof. A first end portion defines a second passageway, the first end of which cooperates with the first end of the first passageway. A first tube retaining plate is disposed within the second passageway and is metallurgically sealed to the first end portion. The first tube retaining plate defines a plurality of apertures through which a corresponding plurality of core tubes extend. The core tubes are sealed relative to the first tube retaining plate. A second tube retaining plate is disposed at the opposite end of the core tubes and includes a plurality of apertures defined thereby. The tubes extend through and are sealed to the second tube retaining plate. A second end portion cooperates with the second end of the first passageway and defines a third passageway which slidably receives the second tube retaining plate therein. A first seal disposed between the first end of the first end portion and the first end of the first passageway seals the first end portion to the housing.

A second seal is disposed around a ring located around and brazed to the second tube retaining plate. The second seal is located between the second end of the first passageway and the second end portion. An adjustable clamp adjustably locates the relative disposition of the two end portions to seal the core tube relative to the housing.

In a more specific embodiment of the invention, the first seal is a gasket and the second seal is an O-ring. The adjustable clamp includes a pair of collars, each of which respectively cooperates with a radially extending flange formed on each of the end portions. Threaded tie rods extend through the collars and are adjusted to locate the relative disposition of the end portions.

The method of making the heat exchanger includes cutting through the second end of the elongated housing in the vicinity of the second tube retaining plate and cutting the second tube retaining plate circumferentially to separate the same from the housing. After cleaning the removed core tubes, a gasket or seal is placed over the core tubes and is positioned adjacent the first end portion. A ring is slipped over the second tube retaining plate and is brazed to the same. The internal surface of the second end portion is ground to remove the remains of the original tube retaining plate. The first and the second end portions are externally machined to provide a radially extending flange on each of the end portions. The core tubes are slid back into the elongated housing until the gasket or seal is disposed between the first end of the first passageway and the first end portion. An O-ring is slipped over and around the ring which partially protrudes from the elongated housing. The second end portion is positioned adjacent the second end of the first passageway and the collars are positioned over the first and second end portions, respectively, such that they abut respectively against the radially extending flanges. The threaded rods are adjusted to alter the relative disposition of the two end portions to seal the core tubes relative to the elongated housing and form a seal between the ring and the housing.

In an alternative embodiment, both ends of the elongated housing are transversely cut through in the vicinity of the tube retaining plates. The second tube retaining plate is cut circumferentially and a ring is slipped over the second tube retaining plate and brazed to the same. The first tube retaining plate is also cut circumferentially and a brass or copper flange having an aperture which corresponds with the diameter of the first tube retaining plate is slipped over the first tube retaining plate and brazed thereto. The core tube is slid back into the elongated housing with the gasket or seal disposed between the first tube retaining plate and the flange of the housing. An O-ring is disposed around the protruding end of the ring and a retainer plate is positioned adjacent the O-ring to urge the O-ring into engagement between the ring and the elongated housing.

In a modification of the preferred embodiment and the alternative embodiment, a counterbore coaxial with the first passageway is defined by the second end of the housing. This counterbore partially receives the O-ring therebetween.

In a still further embodiment of the present invention for converting a flangeless-type heat exchanger into a disassembleable core heat exchanger, the disassembleable core heat exchanger includes an elongated housing having a bore defined by the housing, the bore extending longitudinally through the housing. A counterbore is defined by the elongated housing, the counterbore being coaxial with the bore such that an annular shoulder extends between the bore and the counterbore. A first tube retaining plate is disposed within the bore, the plate defining a first plurality of apertures. A plurality of core tubes are sealingly connected to the first plate such that each of the core tubes is aligned with one of the plurality of apertures. A ring or seal seat encircles the core tubes and is disposed adjacent the retaining plate, and a lead filling or brass/silver solder bonded to the retaining plate is disposed between the ring and the first retaining plate for supporting and re-enforcing the ring. An annular ledge defined by the ring cooperates with the annular shoulder, and the ledge and the shoulder are coplanar. A washer is seated within the counterbore, the washer being seated against both the ledge and the shoulder, and an O-ring is disposed within the counterbore such that the O-ring is housed within an annular groove defined respectively by the counterbore, the shoulder, the ledge and the tube retaining plate. A core retainer is inserted within the counterbore for pressing the O-ring into sealing engagement with the ring and the elongated housing for sealing the annular groove between the first tube retaining plate and the elongated housing.

In a more specific embodiment of this further embodiment of the present invention, the ring or seal seat is of brass or of copper and may be wound from copper wire and is soldered or brazed to the first tube retaining plate. The annular ledge is disposed parallel spaced relative the first tube retaining plate. The O-ring is elastomeric, and the core retainer defines an internal conduit, the conduit being coaxial with and of substantially the same diameter as the bore. The counterbore defines an internal thread which cooperates with an external thread defined by the core retainer such that rotation of the core retainer relative the counterbore results in the O-ring being pressed into sealing engagement between the first tube retaining plate and the housing.

The further embodiment of the present invention includes a method of making a disassembleable core heat exchanger including the steps of removing the core tubes from the elongated housing, securing the tube retaining plate within the ring, filling the space between the tube retaining plate and the ring with molten metal, machining the combined tube retaining plate and ring to provide an annular ledge on the ring and reaming the end portion of the elongated housing to provide a counterbore. The counterbore is coaxial with the bore of the elongated housing such that an annular shoulder extends between the bore and the counterbore. Additionally, the method includes the steps of positioning the tube retaining plate within the elongated housing such that the annular ledge and the annular shoulder are coplanar, seating the washer within the counterbore such that the washer is seated against both the annular ledge and the annular shoulder, inserting the elastomeric O-ring within the counterbore such that the O-ring is housed within the annular groove defined respectively by the counterbore, the annular shoulder, the annular ledge, the ring and the tube retaining plate, and inserting the core tube retainer within the counterbore such that the retainer presses the O-ring into sealing engagement with the tube retaining plate and the elongated housing to seal the groove between the tube retaining plate and the elongated housing.

The alternative method of making a disassembleable core heat exchanger further includes the step of removing the core tubes from the elongated housing by heating the elongated housing in the vicinity of the metallurgical seals to free the core tubes from the elongated housing.

In yet another alternative method of making a disassembleable core tube heat exchanger, the step of removing the core tubes from the elongated housing is accomplished by circumferentially cutting the tube retaining plate adjacent the metallurgical seals to free the core tubes from the elongated housing.

The alternative method of making a disassembleable core tube heat exchanger further includes after the step of removing the core tubes from the elongated housing the step of preparing the tube retaining plate by truing up the flatness of the same and making the circumferential edge of the tube retaining plate such that the tube retaining plate fits within the ring. The alternative method also includes soldering the ring to the tube retaining plate and filling the space between the tube retaining plate and the ring with lead and then cutting away an annular portion of the tube retaining plate, and the ring to provide an annular ledge. The further embodiment also includes the step of fabricating the core tube retainer from a standard iron water pipe of the same external diameter as the external diameter of the elongated housing.

The foregoing has outlined rather broadly the more pertinent and important features of the present invention in order that the detailed description of the invention which follows may be better understood, and so that the present contribution to the art can be more fully appreciated. Additionally, features of the invention disclosed will be disclosed or described hereinafter that form the subject of the claims of the invention. It should be appreciated by those skilled in the art that the conception and specific embodiment disclosed may be readily utilized as a basis for modifying or designing other devices for carrying out the same purposes as the present invention. It should be realized by those skilled in the art that such equivalent constructions do not depart from the spirit and scope of the invention as set forth in the appended claims.

BRIEF DESCRIPTION OF THE DRAWINGS

For further understanding of the nature and objects of the invention, reference should be had to the following description taken in conjunction with the accompanying drawings in which.

Similar reference characters refer to similar parts throughout the several views of the drawings.

DETAILED DESCRIPTION

Figure 1:
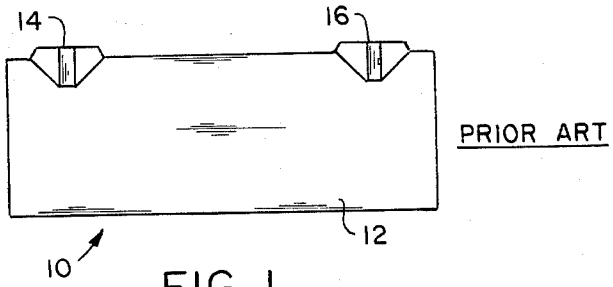
FIG. 1 is a side elevational view of a conventional heat exchanger known in the art.
Figure 2:
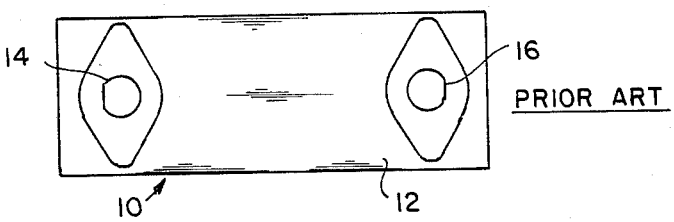
FIG. 2 is a top plan view of the heat exchanger of FIG. 1.

FIG. 1 is a side elevational view of a conventional heat exchanger or oil cooler generally designated 10. The heat exchanger includes an elongated housing 12 and an oil inlet 14 and an oil outlet 16. FIG. 2 is a top plan view showing the inlet and outlet 14 and 16, respectively.

Figure 3:
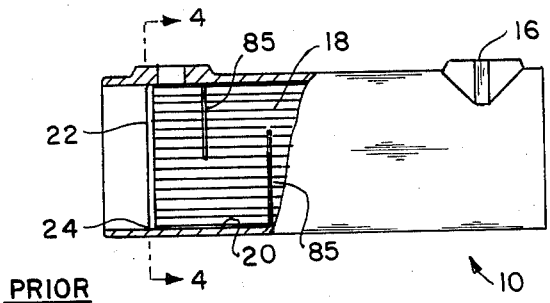
FIG. 3 is a side elevational view partially in section of the heat exchanger of FIG. 1.

FIG. 3, which is a side elevational view of the heat exchanger 10 partially in section, shows the core tubes 18 disposed within a first passageway 20 of the elongated housing 12. A second tube retaining plate 22 is disposed in sealing engagement with the ends of the core tubes 18 and is metallurgically sealed at 24 within the first passageway 20.

Figure 4:
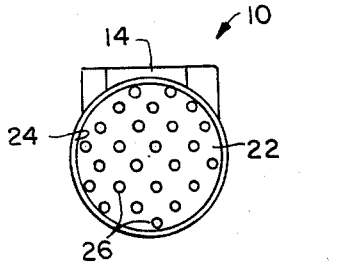
FIG. 4 is a cross sectional view taken on the line 4—4 of FIG. 3.

FIG. 4 is a cross sectional view taken on the line 4—4 of FIG. 3 and shows the second tube retaining plate 22 disposed within the first passageway 20 and metallurgically sealed to the first passageway 20 at 24. The metallurgical seal extends around the periphery of the plate 22. A plurality of apertures 26 are defined by the plate 22 which apertures 26 receivably engage the ends of the core tubes 18 and are sealed thereto.

Figure 5:
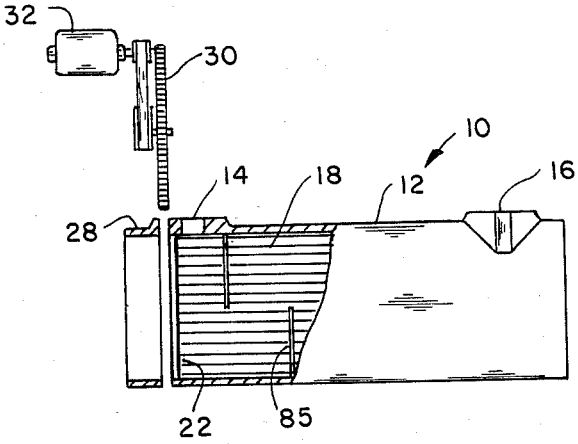
FIG. 5 is a side elevational view partially in section showing the second end portion of the heat exchanger cut off from the elongated housing.

FIG. 5 is a side elevational view of the heat exchanger 10 partially in section showing the second end portion 28 having been cut off from the elongated housing 12 by means of a suitable cutting blade 30 rotated by means of a motor 32. The cutting blade 30 severs the elongated housing 12 from the second tube retaining plate 22. This cutting process is carefully controlled to slightly reduce the diameter of the second tube retaining plate 22 without disturbing the seals between the core tubes 8 and the second tube retaining plate 22.

Figure 6:
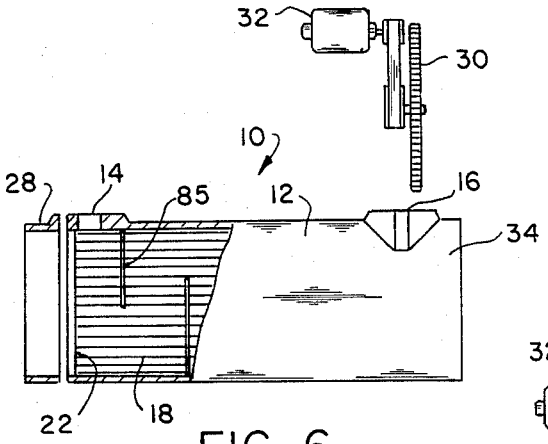
FIG. 6 is a side elevational view of the heat exchanger partially in section showing the cutting blade positioned to cut through the elongated housing adjacent the first end portion.

FIG. 6 illustrates the cutting blade 30 being moved longitudinally relative the elongated housing 12 and ready to cut through the elongated housing in the vicinity of the first tube retaining plate between the elongated housing 12 and the first end portion 34.

Figure 7:
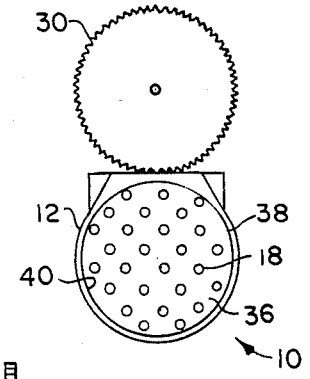
FIG. 7 is an end view of the heat exchanger showing the cutting blade cutting through the elongated housing to remove the first end portion and tube core.
Figure 8:
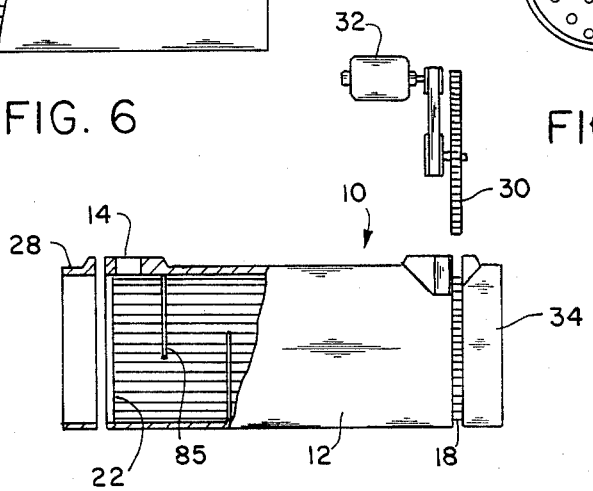
FIG. 8 is a side elevational view partially in section showing the elongated housing having been cut through adjacent the first end portion to enable the core tubes to be removed from the elongated housing.

As shown more clearly in FIGS. 7 and 8 and in a manner similar to FIG. 5, the cutting blade 30 only cuts through the elongated housing 12 and does not cut through any of the plurality of core tubes 18. The core tubes 18 are left attached to a first tube retaining plate 36 which is metallurgically sealed to a second passageway 38 defined by the first end portion 34. The first tube retaining plate 36 is sealed around the periphery thereof to a second passageway 38 by the metallurgical seal 40.

FIG. 8 is a fragmentary side elevational view of the heat exchanger partially in section showing the first end portion 34 separated from the elongated housing 12 and exposing the plurality of core tubes 18.

Figure 9:
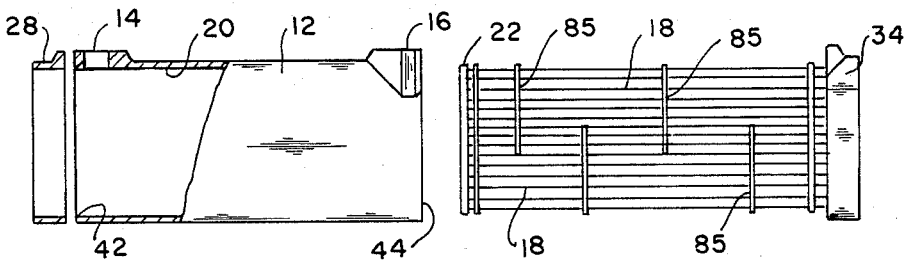
FIG. 9 is a side elevational view of the heat exchanger partially in section showing the first end portion and attached core tubes removed from the elongated housing.

FIG. 9 which is partially in section shows the first end portion 34 and attached core tubes 18 and the second tube retaining plate 22 removed from the elongated housing 12. The first passageway 20 extends along the entire length of the elongated housing between the first end 42 to the second end 44 thereof.

Figures 10, 11, 12, 13:
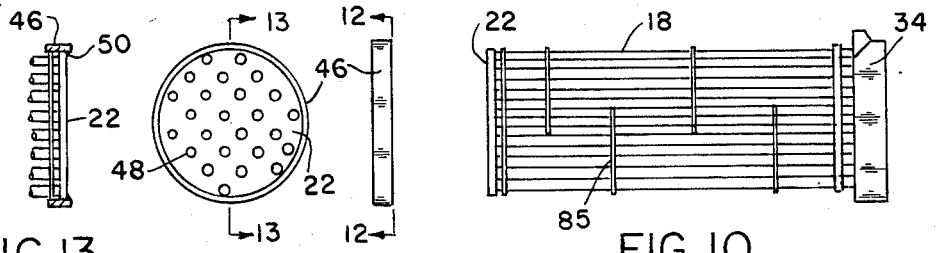
FIG. 10 is a side elevational view of the first end portion and attached core tubes.
FIG. 11 is a side elevational view of the ring.
FIG. 12 is a sectional view taken on the line 12—12 of FIG. 11 but with the ring brazed to the second tube retaining plate.
FIG. 13 is a sectional view taken on the line 13—13 of FIG. 12.

FIG. 10 is a side elevational view of the first end portion 34 and attached core tubes 18. A ring 46 which may be made of brass or copper is shown in FIG. 11 and has an internal diameter slightly greater than the external diameter of the second tube retaining plate 22. The ring 46 is slipped over the second tube retaining plate 22 and attached thereto by suitable means such as brazing.

FIG. 11 shows the ring 46 which is to be brazed to the second tube retaining plate.

FIG. 12 is a section taken on the line 12—12 of FIG. 11 and shows the ring 46 brazed to the second tube retaining plate 22 which defines a plurality of apertures 48 receiving the core tubes 18.

Figure 14:
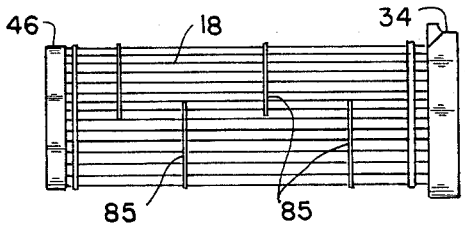
FIG. 14 is a side elevational view of the first end portion and attached core tubes with the ring brazed to the second tube retaining plate.

As shown more particularly in FIG. 13, the second tube retaining plate 22 is encircled by the ring 46 which is brazed at 50 to the second tube retaining plate 22. The plurality of core tubes 18 extend through the apertures 48 in the second tube retaining plate 22 and are sealed thereto as shown in FIG. 14.

Figure 15:
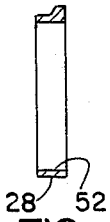
FIG. 15 is a cross sectional view of the second end portion which has been cut off from the elongated housing.
Figure 16:
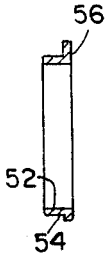
FIG. 16 is a cross sectional view taken on the line 16—16 of FIG. 19 showing the second end portion externally machined to provide a radially extending flange thereon.

FIG. 15 shows the second end portion 28 which is internally ground to remove the peripheral remains of the second tube retaining plate 22. When the second end portion 28 has been internally ground to provide a third passageway 52 defined by the second end portion 28, the second end portion is then externally machined to provide a cylindrical portion 54 and a radially extending flange 56 as shown in FIG. 16.

Figure 17:
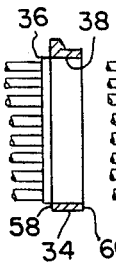
FIG. 17 is a fragmentary side elevational view partially in section of the first end portion and attached core tubes removed from the elongated housing.

FIG. 17 shows in more detail the internal construction of the first end portion 34 which defines the second passageway 38. The passageway 38 extends between a first end 58 and a second end 60 of the first end portion 34. The first tube retaining plate 36 is metallurgically sealed to the second passageway 38.

Figure 18:
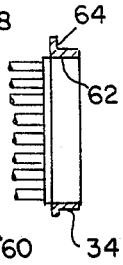
FIG. 18 shows the first end portion externally machined to provide a radially extending flange thereon.

As shown in FIG. 18, the first end portion 34 is externally machined to provide a cylindrical portion 62 and a radially extending first flange 64.

Figure 19:
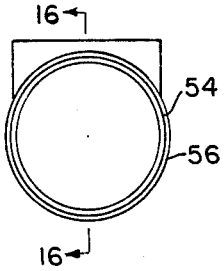
FIG. 19 is an end view of the second end portion after external machining.
Figure 20:
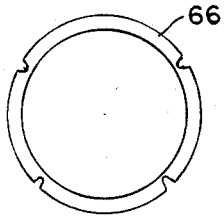
FIG. 20 is an end view of the first seal.
Figure 21:
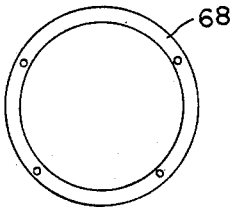
FIG. 21 is an end view of one of the collars.

FIG. 19 is an end view of the second end portion 28 showing the cylindrical portion 54 and second flange 56. FIG. 20 is an end view of the first seal 66 in the form of a gasket. FIG. 21 is an end view of one of the collars which cooperates with the cylindrical portion of the end portions.

Figure 22:
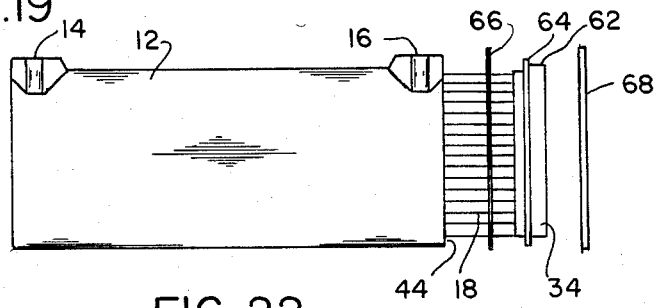
FIG. 22 is a side elevational view of the heat exchanger partially reassembled.

FIG. 22 shows the core tubes 18 partially reassembled within the elongated housing 12 with the gasket or first seal 66 interposed between the second end 44 of the passageway 20 and the first flange 64 of the first end portion 34.

Figure 23:
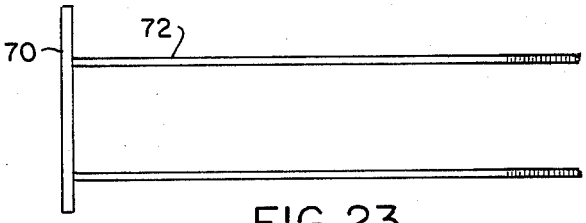
FIG. 23 is a side elevational view of one of the collars and attached threaded tie rods.
Figure 24:
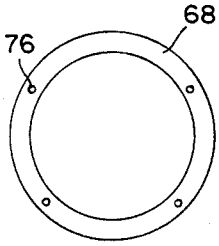
FIG. 24 is an end view of a collar which cooperates with the tie rods shown in FIG. 23.

FIG. 23 shows another collar 70 having a plurality of tie rods 72 extending therefrom. The collar 70 is slipped over the cylindrical portion 54 of the second end portion 28 until it abuts against the second flange 56 and cooperates with collar 68 shown in FIG. 24.

Figure 25:
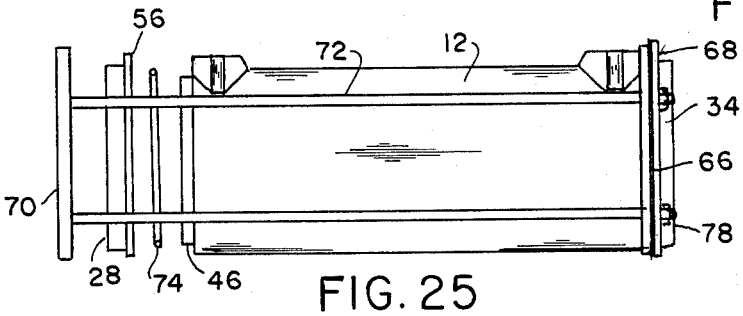
FIG. 25 is a side elevational view partially in section of the core tubes reassembled within the elongated housing and with the second seal ready to be positioned around the ring.
Figure 26:
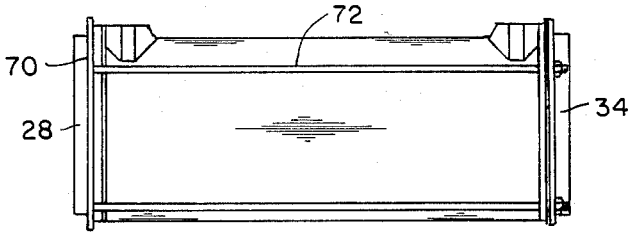
FIG. 26 is a side elevational view of the reassembled heat exchanger partially in section showing the two end portions adjustably clamped relative each other.
Figure 27:
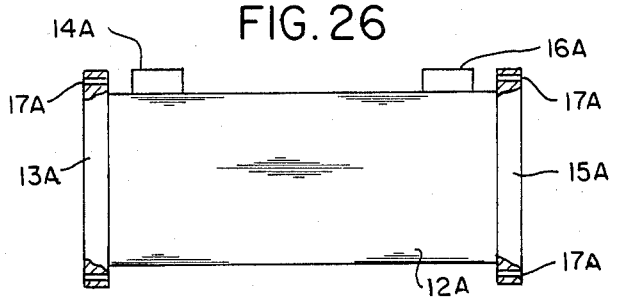
FIG. 27 is a side elevational view partially in section of an alternative embodiment of the present invention.

As shown in FIG. 25, an elastomeric O-ring 74 which forms a second seal is slipped over and around the protruding end of the ring 46. The second end portion 28 is moved longitudinally until the second flange 56 abuts against the O-ring 74. The other collar 68 is slipped over the cylindrical portion 62 of the first end portion and the tie rods 72 are located within corresponding apertures 76 defined by the collar 68. Nuts 78 are threaded onto the threaded ends of the tie rods 72 to adjustably clamp the first end portion relative to the second end portion and to engage the second seal into engagement, respectively, with the ring 46 and the elongated housing 12. FIG. 26 shows the heat exchanger in assembled form.

The method of making the disassembleable core heat exchanger of the present invention involves the steps of cutting through the elongated housing 12 in the vicinity of the second tube retaining plate and removing the second end portion 28 therefrom. The cutting is accomplished by means of the cutting blade 30 or any other suitable cutting means such as a powered hacksaw blade or the like. The cut is made transverse to the longitudinal axis of the housing 12. The cut through the housing 12 is carefully controlled to slightly reduce the diameter of the second tube retaining plate without disturbing the seals between the core tubes 18 and the second tube retaining plate 22.

The cutting blade 30 is next positioned adjacent the opposite end of the elongated housing 12 in the vicinity of the first tube retaining plate and is positioned such that it will circumferentially cut through the elongated housing 12 but slightly towards the middle of the housing 12 to permit the first end portion 34 and the attached core tubes 18 to be slidably removed from the housing 12.

Cleaning and treating of the core tubes is carried out subsequent to removal of the same from the housing 12. Additionally, tests can be carried out to check for the presence of minute holes in the core tubes 18.

The second end portion 28 is internally ground to remove any peripheral remains of the second tube retaining plate and metallurgical weld disposed on the internal surface of the portion 28.

The second end portion 28 is then externally machined to provide the cylindrical portion 54 and the radially extending second circumferential flange 56 thereon. The first end portion 34 is externally ground to provide the cylindrical portion 62 and the radially extending first circumferential flange 64 thereon.

The second tube retaining plate 22 and brazed ring 46 and attached core tubes 18 are passed through the first seal or gasket 66 and the plate 22, ring 46 and tubes 18 are reassembled within the housing 12 until the seal 66 is disposed between the first flange 64 and the first end 42 of the first passageway 20.

The second seal or elastomeric O-ring 74 is slipped over the protruding end of the ring 46. The second flange 56 is located adjacent the second seal 74 and adjustably clamps the end portions 28 and 34 relative each other to form a seal between the first end portion and the first end of the housing and between the ring 46 and the second end of the housing, respectively.

More specifically, the adjustable clamping means involves placing the collar 70 with attached tie rods 72 over the cylindrical portion 54 and placing the other collar 68 over the cylindrical portion 62, locating the ends of the tie rods 72 within the apertures 76 and capturing the collar 68 by means of the nuts 78 which cooperate with the threaded tie rods 72.

Figure 28:
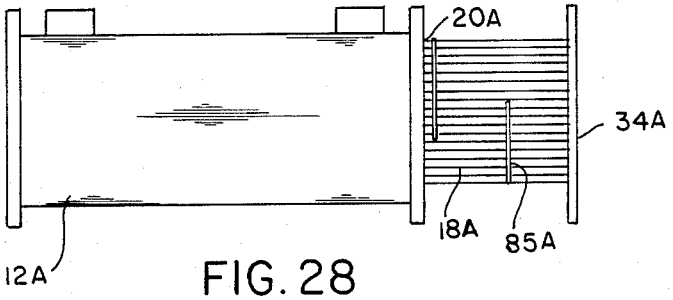
FIG. 28 is a side elevational view of the embodiment of FIG. 27 showing the first end portion and attached core tubes partially removed from the elongated housing.
Figure 29:
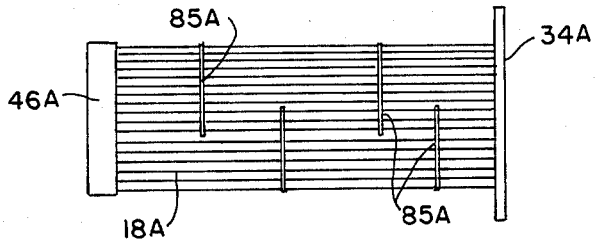
FIG. 29 is a side elevational view of the core tubes with a ring brazed onto the second tube retaining plate and a flange brazed onto the first tube retaining plate.
Figure 30:
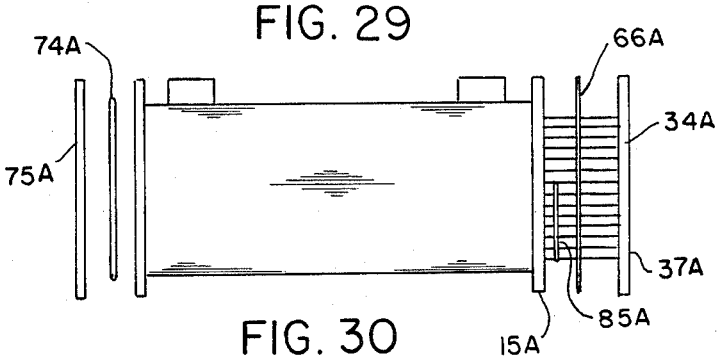
FIG. 30 is an exploded view of the heat exchanger shown in FIG. 28 with the first seal located between the brazed flange and the first end of the first passageway.
Figure 31:
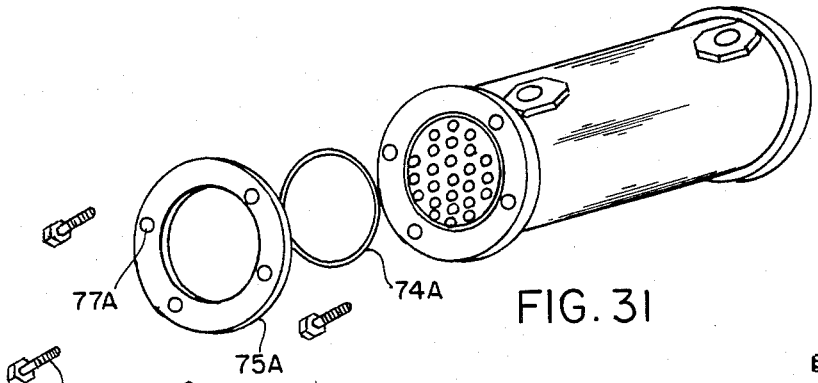
FIG. 31 is an exploded perspective view of the heat exchanger showing the O-ring ready to be slipped over the protruding end of the ring.

In an alternative embodiment of the present invention as shown in FIGS. 27–32, the elongated housing 12A includes an oil inlet 14A and an oil outlet 16A. The housing 12A includes a flange 13A adjacent one end thereof and a flange 15A adjacent the other end. Each flange 13A and 15A includes apertures 17A defined by the flanges 13A and 15A, respectively. The flange 13A is cut through in the vicinity of the second tube retaining plate as shown in FIG. 28 by the cutting blade 30A (not shown). The flange 15A is then cut through in the vicinity of the first tube retaining plate and transversely to the longitudinal axis of the housing 12A. The flange 15A is cut slightly towards the middle of the housing 12A so as not to disturb the metallurgical seal between the first tube retaining plate and the first end portion 34A of the flange. This cutting through of the flange 15A is accomplished without cutting through the core tubes 18A. The core tubes 18A and attached first end portion 34A are slidably removed from the first passageway 20A of the housing 12A.

With the first end portion 34A and attached core tubes 18A removed from the housing 12A, the second tube retaining plate is slipped into a ring 46A. A gasket or seal 66A is slipped over the ring 46A and core tubes 18A and the ring 46A and core tubes 18A are replaced with the housing 12A such that the gasket 66A is disposed between the first end of the first passageway 20A and the flange 34A.

An O-ring or second seal of elastomeric materials 74A is slipped over the protruding portion of a ring 46A which is slipped over and brazed to the second tube retaining plate. The second seal 74A is urged between the ring 46A and the housing 12A by means of a locating plate 75A provided with a plurality of apertures 77A and cooperating bolts 79A. The bolts 79A adjustably urge the locating plate 75A against the O-ring 74A.

The removable core cooler of the present invention makes possible the repair of coolers and heat exchangers where replacement of the same would otherwise be required.

In the event of a leak being detected in the metallurgical seal of one of the tube retaining plates, this metallurgical seal would be selected to be cut and replaced with a brazed ring and O-ring seal.

If both tube retaining plates are found to be leaking, both metallurgical seals can be cut and replaced by brazed rings or end portions.

Fretting corrosion of the core tubes at the supporting baffles is arrested by soldering the tubes at the joints between the tubes and associated baffles or by immersing the removable core tubes in a solder bath. This eliminates vibration-induced fretting corrosion between the core tubes and the supporting baffles 85 and 85A, respectively.

On removal of the core tubes from the housing, if one or more core tubes is detected as leaking, the defective tube is drilled free from both tube retaining plates and removed from the core. A replacement tube can be brazed or soldered to the tube retaining plates with no danger of interfering with the seals between the tube retaining plates and the housing.

Figure 32:
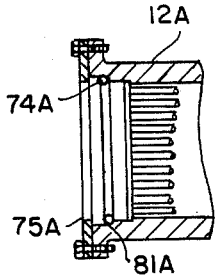
FIG. 32 is a sectional view of a modification of the alternative embodiment showing a counterbore of the first passageway.

As in the case of the preferred embodiment, the first passageway may include counterbore 81A which houses O-ring 74A as shown in FIG. 32.

Figure 33:
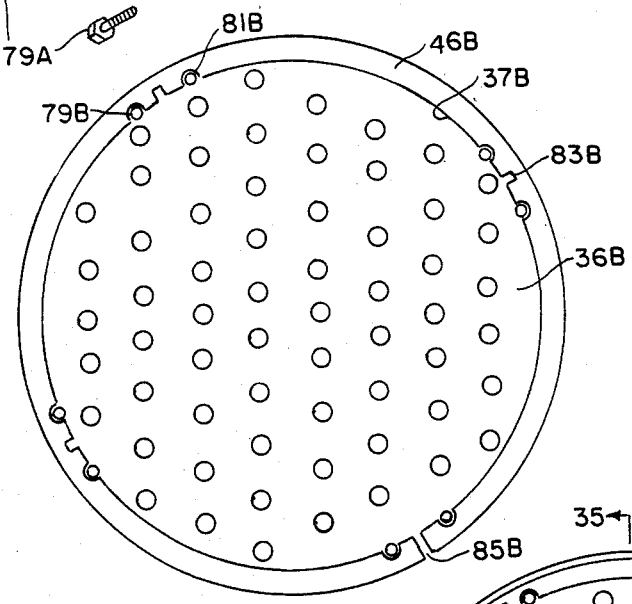
FIG. 33 is an end view of one of the tube retaining plates and connected core tubes showing the ring encircling the retaining plate and soldered to the same.
Figure 34:
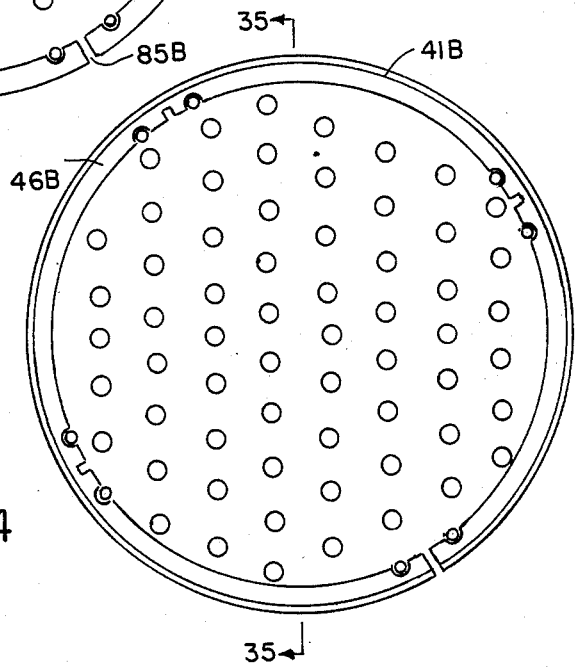
FIG. 34 is an end view of the tube retaining plate and the ring as shown in FIG. 33 but with an annular ledge cut in the ring.
Figure 36:
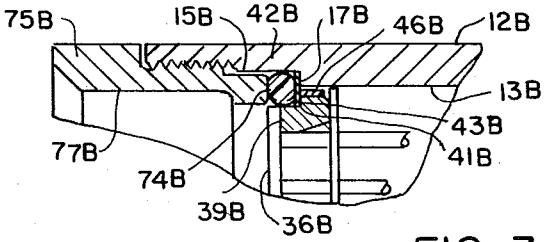
FIG. 36 is an enlarged fragmentary view of a portion of the heat exchanger of FIG. 35 showing the core retainer pressing the O-ring seal into sealing engagement with the tube retaining plate and the elongated housing.
Figure 35:
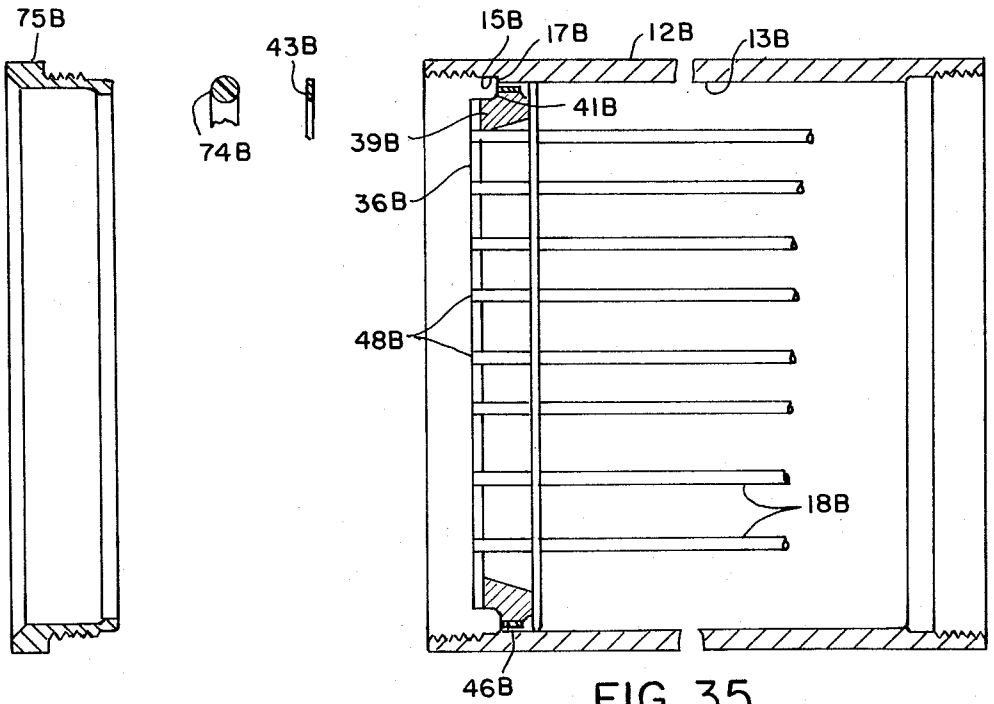
FIG. 35 is a sectional view of the tube retaining plate and the ring shown in FIG. 34 taken on the line 35—35 of FIG. 34 and additionally showing the tube retaining plate located within the elongated housing.

In a further embodiment of the present invention as shown in FIGS. 33–36, an elongated housing 12B as shown in FIGS. 35 and 36 defines a bore 13B which extends longitudinally through the housing 12B. A counterbore 15B is defined by an end of the elongated housing 12B such that the counterbore 15B is coaxial with the bore 13B. An annular shoulder 17B extends between the bore 13B and the counterbore 15B. A first tube retaining plate 36B is disposed within the bore 13B with the plate 36B defining a plurality of apertures 48B. A plurality of core tubes 18B are disposed within the bore 13B and are sealingly connected to the first plate 36B such that each of the core tubes 18B is aligned with one of the plurality of apertures 48B. A ring or seal seat 46B encirlces the core tubes and is disposed adjacent the first retaining plate 36B. The ring 46B is soldered or otherwise connected to the first tube retaining plate 36B by the soldering indicating by the numeral 37B. Alternatively, the ring or seal seat 46B may be wound from copper wire and brazed to the plate 36B. Molten lead or other suitable filling material such as brass/silver solder 39B is flowed into the space behind the tube retaining plate 36B as shown in FIGS. 35 and 36. When the filling material 39B has solidified the periphery of the first tube retaining plate 36B and attached ring 46B are machined to provide an annular ledge 41B as shown particularly with reference to FIGS. 34, 35 and 36. The annular ledge 41B cooperates with the annular shoulder 17B and is coplanar therewith when the core tubes are located within the elongated housing 12B. A washer 43B shown particularly in FIG. 35 is disposed within the counterbore 15B and is seated against both the ledge 41B and the shoulder 17B. An elastomeric O-ring 74B is inserted within the counterbore 15B such that the O-ring 74B is housed within the annular groove defined respectively by the counterbore 15B, the shoulder 17B, the ledge 41B, and the tube retaining plate 36B. The internal surface of the counterbore 15B is internally threaded to cooperate with an externally-threaded portion of the core retainer 75B shown in FIGS. 35 and 36. The core retainer 75B which may be fabricated from a suitable iron water pipe or die cast aluminum, or reinforced plastic material or by powder metalury process rotatably connects with the thread formed on the counterbore 15B such that continued rotation of the core retainer 75B results in the core retainer 75B pressing the O-ring 74B into sealing engagement with the tube retaining plate 36B and the elongated housing 12B. The core retainer 75B defines an internal conduit 77B, enabling passage of fluid through the core tubes.

As shown in FIGS. 33 and 34, the ring or seal seat 46B maya be preformed with a plurality of indentations 79B, 81B, and 83B such that the ring 46B can closely conform to the outer periphery of the bundle of core tubes and tube supports. The ring 46B may be split at 85B in order to facilitate the engagement of the ring with the periphery of the bundle of core tubes and tube retaining plate 36B.

In operation of the present invention, the following steps are carried out in order to convert a flangless-type heat exchanger into a disassembleable core heat exchanger. These steps include removing the core tubes 18B from the elongated housing 12B and securing the tube retaining plate 36B within the ring 46B. The space between the tube retaining plate 36B and the ring 46B is filled with molten lead or other suitable material. The combined tube retaining plate 36B and the ring 46B are machined to provide an annular ledge 41B on the ring 46B. The end portion of the elongated housing 12B is reamed to provide a counterbore 15B, the counterbore being coaxial with the bore 13B of the housing 12B such that an annular shoulder 17B extends between the bore 13B and the counterbore 15B. The tube retaining plate 36B is positioned within the elongated housing 12B such that the annular ledge 41B and the annular shoulder 17B are coplanar. A washer 43B is inserted within the counterbore 15B such that the washer is seated against both the annular ledge 41B and the annular shoulder 17B. An elastomeric O-ring 74B is inserted within the counterbore 15B such that the O-ring 74B is housed within the annular groove defined respectively by the counterbore 15B, the annular shoulder 17B, the annular ledge 41B, and the tube retaining plate 36B. A core tube retainer 75B is inserted within the counterbore 15B by rotatably engaging the thread of the core tube retainer 75B with the internal threading of the counterbore 15B such that the retainer presses the O-ring 74B into sealing engagement with the tube retaining plate 36B and the elongated housing 12B to seal the groove between the tube retaining plate and the elongated housing.

In a more specific embodiment of the present invention, the core tubes are removed from the elongated housing 12B either by heating the elongated housing in the vicinity of the metallurgical seals to free the core tubes from the elongated housing or, alternatively, by circumferentially cutting the tube retaining plate 36B adjacent the metallurgical seals to free the core tubes from the elongated housing. Furthermore, in preparing the tube retaining plate prior to encircling the same with the ring 46B, the tube retaining plate 36B is prepared by truing up the flatness of the tube retaining plate 36B and flattening the same prior to the encircling of the tube retaining plate 36B with the ring 46B. Also, the ring 46B is secured to the tube retaining plate either by soldering the same or brazing the same to the peripheral edge of the tube retaining plate. After the ring has been secured to the periphery of the tube retaining plate 36B, the molten lead or other molten metal is flowed into the space defined by the ring and the tube retaining plate 36B such that the molten metal when solidified strengthens and reenforces the combined ring 46B and tube retaining plate 36B. When the lead or molten metal has solidified the ring 46B and the periphery of the tube retaining plate 36B are machined to cut away an annular portion of the tube retaining plate 36B, and the ring 46B to provide an annular ledge 41B.

The present invention provides not only a core heat exchanger that is easily disassembled for routine maintenance and testing but also a method of making a disassembleable heat exchanger that avoids the costly requirement of replacing an expensive heat exchanger unit as has been the custom in the prior art.

The present disclosure includes that contained in the appended claims as well as that of the foregoing description. Although the invention has been described in its preferred form with a certain degree of particularity, it is understood that the present invention of the preferred form has been made only by way of example, that numerous changes in the details of construction and the combination and arrangement of parts may be resorted to without departing from the spirit and scope of the invention.

What is claimed is:

1. A method of manufacturing a disassembleable core heat exchanger which is interposed between a first and second fluid coupling and of the type including an elongated housing having a first and second flow port and having core tubes positioned within a bore of the housing and a first and second tube retaining plate sealed at opposite ends of the core tubes to enable a first fluid path and a second fluid path within the housing comprising the steps of:

cutting both ends of the elongated housing in the vicinity of the tube retaining plates;

circumferentially cutting the first and second tube retaining plates to enable the core tubes to be removable from the housing;

removing the core tubes from the housing;

securing in a fluid tight manner a first flange having a central aperture corresponding to the diameter of the cut first tube retaining plate to the first tube retaining plate;

securing in a fluid tight manner a ring around the periphery of the second tube retaining plate such that the ring protrudes relative the elongate housing to provide a sealing surface;

slipping a first gasket over the core tubes;

sliding the second tube retaining plate and ring back into the housing to enable the housing to engage the gasket and first flange and with the ring protruding relative the housing;

passing an O-ring seal over the protruding end of the ring so that the O-ring seal encircles the ring;

positioning a locating plate adjacent to the O-ring seal to enable the housing to sealingly engage the first and second coupling to enable a first flow path between the first and second housing ports for the first fluid independent of a second flow path between the first and second coupling for the second fluid upon sealingly affixing the disassembleable core heat exchanger to the first and second coupling.

2. A method of manufacturing a disassembleable core heat exchanger as set forth at claim 1 including the step of reaming the bore of the elongated housing to provide a counterbore coaxial with the bore of the housing to partially receive the O-ring between the ring and the counterbore and to sealingly engage the ring, the counterbore and the locating plate.

3. A method of manufacturing a disassembleable core heat exchanger as set forth at claim 1 wherein the first flange is secured in a fluid tight manner to the first tube retaining plate and the ring is secured in a fluid tight manner about the periphery of the second tube retaining plate by brazing.

4. A method of manufacturing a disassembleable core heat exchanger as set forth at claim 1 including the step of cleaning and treating the core tubes to remove debris and to check for the presence of undesirable holes in the core tubes.

5. A method of manufacturing a disassembeable core heat exchanger which is interposed between a first and second fluid coupling and of the type including an elongated housing having a first and second end portion with a first and second flow port disposed between the first and second end portion and having core tubes positioned within a bore which extends longitudinally through the elongated housing and a first and second tube retaining plate sealed at opposite ends of the core tubes to enable a first fluid path and a second fluid path within the housing comprising the steps of:

transversely cutting through the elongated housing in the vicinity of the second tube retaining plate;

circumferentially cutting the second tube retaining plate such that the second end portion can be removed from the housing;

circumferentially cutting through the elongated housing transversely to the housing in the vicinity of the first tube retaining plate to permit the first end portion and attached core tubes to be slidably removed from the elongated housing;

internally grinding the second end portion to remove the peripheral remains of the second tube retaining plate therefrom;

externally machining the second end portion to provide the radially extending second circumferential flange thereon;

slipping a ring over the second tube retaining plate such that the ring protrudes relative the elongate housing to provide a sealing surface and brazing the same thereto;

externally machining the first end portion to provide a first radially extending circumferential flange portion;

passing the ring, the second tube retaining plate and attached tubes through a first seal until the seal engages the first circumferential flange;

sliding the ring, the second tube retaining plate and the attached core tubes through the bore which extends longitudinally through the elongated housing until the first seal is disposed between the first circumferential flange and the housing;

sliding a second seal around the protruding end of the ring;

locating the second circumferential flange of the second end portion adjacent the second seal and adjustably clamping the end portions relative each other to sealingly engage the ring with the housing to enable a first flow path between the first and second housing ports for the first fluid independent of a second flow path between the first and second fluid coupling for the second fluid upon sealingly affixing the disassembleable core heat exchanger to the first and second coupling.

6. A method of manufacturing a disassembleable core heat exchanger as set forth at claim 5 including the step of cleaning and treating the core tubes to remove debris and to check for the presence of undesirable holes in the core tubes.

7. A method of manufacturing a disassembleable core heat exchanger from a flangless core heat exchanger which is interposed between a first and second fluid coupling means and of the type including an elongated housing having a first and second flow port disposed between the first and second end portion of the elongated housing and having core tubes positioned within a bore which extends longitudinally through the elongated housing and a first and second tube retaining plate sealed at opposite ends of the core tubes to enable a first fluid path and a second fluid path within the housing comprising the steps of:

removing the core tubes from the elongated housing;

securing in a fluid tight manner a ring around the periphery of the first tube retaining plate such that the ring is substantially coplanar the periphery of the first tube retaining plate;

filling the space between the first tube retaining plate and the ring with molten metal;

machining the combined tube retaining plate and ring to provide an annular ledge on the ring;

reaming the first end portion of the elongated housing to provide a counterbore, the counterbore being coaxial with the bore of the elongated housing such that an annular shoulder extends between the bore and the counterbore;

positioning the tube retaining plate within the elongated housing such that the annular ledge and the annular shoulder are substantially coplanar;

seating a washer within the counterbore such that the washer is seated against both the annular ledge and the annular shoulder;

inserting an elastomeric O-ring within the counterbore such that the O-ring is housed within the annular groove defined respectively by the counterbore, the annular shoulder, the annular ledge and the tube retaining plate; and inserting a core tube retainer within the counterbore such that the retainer presses the O-ring into sealing engagement with the tube retaining plate and the elongated housing to seal the tube retaining plate relative the elongated housing to enable a first flow path between the first and second housing ports for the first fluid independent of a second flow path between the first and second fluid coupling for the second fluid upon sealingly affixing the disassembleable core heat exchanger to the first and second coupling.

8. A method of making a disassembleable core heat exchanger as set forth in claim 7 wherein said step of removing the core tubes from the elongated housing is accomplished by:

heating the elongated housing in the vicinity of the metallurgical seals to free the core tubes from the elongated housing.

9. A method of making a disassembleable core heat exchanger as set forth in claim 7 wherein said step of removing the core tubes from the elongated housing is accomplished by:

circumferentially cutting the tube retaining plate adjacent the metallurgical seals to free the core tubes from the elongated housing.

10. A method of making a disassembleable core heat exchanger as set forth in claim 7 further including after the step of removing the core tubes from the elongated housing, the step of:

preparing the tube retaining plate by truing up the flatness of the same and making the circumferential edge of the same such that the tube retaining plate fits within the ring.

11. A method of making a disassembleable core heat exchanger as set forth in claim 7 wherein said step of securing the tube retaining plate within the ring further includes:

soldering the ring to the tube retaining plate.

12. A method for making a disassembleable core heat exchanger as set forth in claim 7 wherein said step of filling the space between the tube retaining plate and the ring includes:

filling the space with lead.

13. A method of making a disassembleable core heat exchanger as set forth in claim 7 wherein said step of machining the retaining plate and ring includes:

cutting away an annular portion of the tube retaining plate and the ring to provide the annular ledge.

14. A method of making a disassembleable core heat exchanger as set forth in claim 7 wherein said step of reaming is followed by the further steps of:

forming an internal thread on the counterbore; and forming an external thread on the core tube retainer for cooperating with the internal thread of the counterbore.

15. A method of making a disassembleable core heat exchanger as set forth in claim 7 further including the step of:

fabricating the core tube retainer from a standard iron water pipe of the same external diameter as the external diameter of the elongated housing.

16. A method of manufacturing a disassembleable core heat exchanger as set forth at claim 5 including the step of cleaning and treating the core tubes to remove debris and to check for the presence of undesirable holes in the core tubes.

* * * * *